US009314052B2

(12) United States Patent
Donmoyer

(10) Patent No.: US 9,314,052 B2
(45) Date of Patent: Apr. 19, 2016

(54) APPAREL POUCH ASSEMBLY

(71) Applicant: Greg Edwin Donmoyer, Lykens, PA (US)

(72) Inventor: Greg Edwin Donmoyer, Lykens, PA (US)

( * ) Notice: Subject to any disclaimer, the term of this patent is extended or adjusted under 35 U.S.C. 154(b) by 0 days.

(21) Appl. No.: 14/633,243

(22) Filed: Feb. 27, 2015

(65) Prior Publication Data

US 2015/0181946 A1 Jul. 2, 2015

Related U.S. Application Data

(63) Continuation of application No. PCT/US2013/058439, filed on Sep. 6, 2013.

(60) Provisional application No. 61/697,673, filed on Sep. 6, 2012.

(51) Int. Cl.

| | |
|---|---|
| ***A41B 9/12*** | (2006.01) |
| ***A41B 9/02*** | (2006.01) |
| ***A41B 9/00*** | (2006.01) |

(52) U.S. Cl.

CPC ..... *A41B 9/023* (2013.01); *A41B 9/004* (2013.01)

(58) Field of Classification Search

CPC ..... A41B 9/02; A41B 9/023; A41B 9/007; A41B 2300/32; A41B 9/008; A41B 9/026; A41B 9/08; A41D 7/005; A41D 13/1254; A41D 1/08; A41D 2300/33

See application file for complete search history.

(56) References Cited

U.S. PATENT DOCUMENTS

| | | | | | |
|---|---|---|---|---|---|
| 2,438,310 | A | * | 3/1948 | Ashe | A41B 9/02 2/403 |
| 2,624,336 | A | * | 1/1953 | Hansley | A41B 9/02 2/234 |
| 3,844,282 | A | * | 10/1974 | King | A41B 9/023 2/405 |
| 4,134,400 | A | * | 1/1979 | DiMatteo | A61F 5/40 602/72 |
| 4,195,630 | A | * | 4/1980 | Connery | A61F 5/40 2/403 |
| 4,215,685 | A | * | 8/1980 | Ibel | A41D 1/06 2/227 |
| 4,377,008 | A | * | 3/1983 | Jung | A41B 9/023 2/403 |
| 4,414,971 | A | * | 11/1983 | Chung | A61F 5/40 2/405 |
| 4,526,167 | A | * | 7/1985 | Ebenal | A41B 9/023 2/403 |
| 4,690,681 | A | * | 9/1987 | Haunschild | A61F 13/496 604/396 |
| 4,705,512 | A | * | 11/1987 | Faucher | A61F 5/4404 604/332 |
| 4,835,795 | A | * | 6/1989 | Lonon | A41B 9/007 2/408 |
| 4,870,958 | A | * | 10/1989 | Webster | A61F 5/40 128/891 |
| 4,930,161 | A | * | 6/1990 | Cohen | A41D 13/1254 2/114 |
| 4,955,088 | A | * | 9/1990 | Terjesen | A41B 9/02 2/403 |
| 4,961,419 | A | * | 10/1990 | Tribble | A41B 9/023 2/403 |
| 4,967,768 | A | * | 11/1990 | Tatro | A41B 9/02 128/891 |
| 5,029,345 | A | * | 7/1991 | Angheluta | A41B 9/023 2/403 |
| 5,093,935 | A | * | 3/1992 | Countee, Jr. | A41B 9/02 2/247 |
| 5,275,592 | A | * | 1/1994 | Grizzaffi | A41F 5/4401 2/403 |
| 5,435,015 | A | * | 7/1995 | Ellis-Brewer | A41B 9/001 2/400 |

(Continued)

FOREIGN PATENT DOCUMENTS

| | | | |
|---|---|---|---|
| RU | 86471 | U1 | 9/2009 |
| RU | 2368292 | C1 | 9/2009 |
| RU | 2409995 | C1 | 1/2011 |

OTHER PUBLICATIONS

International Search Report in corresponding PCT/US2013/058439, Dec. 3, 2013, 6 pages.

*Primary Examiner* — Bobby Muromoto, Jr.
(74) *Attorney, Agent, or Firm* — Hooker & Habib, P.C.

(57) ABSTRACT

A flexible pouch for an apparel item to support a portion of a wearer's body, particularly a pouch for use in male apparel such as undergarments and swimwear.

20 Claims, 6 Drawing Sheets

(56) References Cited

U.S. PATENT DOCUMENTS 5,535,452 A * 7/1996 Rozenblat ..... A41D 13/1254 2/403
5,819,323 A * 10/1998 Edenfield ..... A41B 9/02 2/403
5,870,779 A * 2/1999 Heron ..... A41B 9/023 2/400
D408,964 S * 5/1999 Hernandez ..... D2/700
5,906,876 A * 5/1999 Conway ..... A41B 17/00 428/88
5,920,914 A * 7/1999 Dempsey ..... A41B 9/02 2/400
5,951,365 A * 9/1999 Fildan ..... A41C 3/122 450/41
6,018,822 A * 2/2000 Hernandez ..... A41B 9/02 2/405
6,023,789 A * 2/2000 Wilson ..... A41B 9/02 2/228
6,092,240 A * 7/2000 Weller ..... A41D 13/1254 2/114
6,145,132 A * 11/2000 Towner ..... A41B 9/02 2/400
6,199,215 B1 * 3/2001 Biggerstaff ..... A41D 1/06 2/234
6,412,119 B1 * 7/2002 Robles ..... A41B 9/007 2/400
6,415,450 B1 * 7/2002 Lien ..... A41B 9/02 2/400
D483,549 S 12/2003 Caldwell
6,662,378 B2 * 12/2003 Vartanyan ..... A41B 9/02 2/400
D506,303 S 6/2005 Rocha
7,017,193 B2 * 3/2006 Auger ..... A41B 9/023 2/403
D603,582 S 11/2009 Fennell
7,757,307 B2 * 7/2010 Wong ..... A41B 9/02 2/228
7,774,865 B2 * 8/2010 Miller ..... A41B 9/02 2/400
7,788,739 B1 * 9/2010 Della Ratta ..... A41B 9/023 2/400
D648,098 S 11/2011 Mitchell
D660,551 S 5/2012 Steele
8,171,573 B2 * 5/2012 Chun ..... A41C 1/08 2/465
8,561,213 B2 * 10/2013 Howell ..... A41B 1/08 2/2.5
8,601,616 B2 * 12/2013 Radford ..... A41B 9/02 2/400
8,763,167 B2 * 7/2014 Howell ..... A41B 1/08 2/2.5
8,784,351 B2 * 7/2014 Dumpson ..... A41C 1/02 2/401
9,003,571 B1 * 4/2015 Lewis-Williams ..... A41B 9/04 2/250
9,044,329 B2 * 6/2015 Ziehler ..... A44B 9/02
2006/0174400 A1 8/2006 Kurata
2009/0036857 A1 * 2/2009 Sherrod ..... A61F 13/491 604/385.3
2009/0257689 A1 * 10/2009 Motsch ..... B65D 75/56 383/207
2010/0152687 A1 * 6/2010 Carlozzi ..... A41B 9/04 604/359
2010/0275350 A1 * 11/2010 Wong ..... A41B 9/02 2/466
2011/0307996 A1 * 12/2011 Radford ..... A41B 9/02 2/404
2012/0023645 A1 * 2/2012 Murphy ..... A41B 9/12 2/400
2012/0124712 A1 * 5/2012 Vanlandingham ... B65D 75/008 2/67
2012/0167279 A1 * 7/2012 Bigney ..... A41B 9/02 2/401
2012/0246806 A1 * 10/2012 Lane ..... A41B 13/005 2/404
2012/0260404 A1 * 10/2012 Steele ..... A41B 9/023 2/404
2012/0272440 A1 * 11/2012 Landi ..... A41D 13/0575 2/466
2012/0304364 A1 * 12/2012 Landi ..... A41B 9/12 2/403
2012/0316626 A1 * 12/2012 Dolivier ..... A61F 7/02 607/108
2013/0291269 A1 * 11/2013 Howell ..... F41H 1/02 2/2.5
2013/0291287 A1 * 11/2013 Shoemaker ..... A41B 9/008 2/403
2014/0026295 A1 * 1/2014 McIntyre ..... A41B 9/02 2/403
2014/0026296 A1 * 1/2014 Steele ..... A41B 9/023 2/403
2014/0058312 A1 * 2/2014 Ziehler ..... A44B 9/02 602/72
2014/0275906 A1 * 9/2014 Hackenburg ..... A61M 5/142 600/365
2014/0359920 A1 * 12/2014 Sabin ..... A41B 9/004 2/406
2014/0378936 A1 * 12/2014 Coates ..... A61F 13/505 604/396
2015/0047107 A1 * 2/2015 Crissman ..... A41B 9/023 2/403
2015/0047108 A1 * 2/2015 Crissman ..... A41B 9/026 2/405
2015/0282996 A1 * 10/2015 Newton ..... A61F 13/505 604/385.14
2015/0290049 A1 * 10/2015 Riha-Scott ..... A61F 13/49004 604/387
2015/0313290 A1 * 11/2015 Bigney ..... A41B 9/02 2/401

* cited by examiner

APPAREL POUCH ASSEMBLY

This application is a continuation of my co-pending PCT application for Apparel Pouch Assembly, Application No. PCT/US2013/058439 filed Sep. 6, 2013, which PCT application is a non-provisional of my U.S. Provisional Application No. 61/697,673 filed Sep. 6, 2012, said PCT and Provisional patent applications incorporated by reference herein.

FIELD OF THE DISCLOSURE

The disclosure relates to apparel items having structure to accommodate and support portions of user's body, particularly to underwear, swimwear and active wear having a pouch for accommodating male genitalia and a fly for allowing a wearer access to the pouch interior.

BACKGROUND OF THE DISCLOSURE

Apparel items having structure to support portions of a wearer's body are known. In particular, male apparel and undergarments having structures to accommodate male genitalia are known.

Traditional European codpieces developed as early as the 15th and 16th centuries were covering flaps attached to the front of the crotch of men's trousers or pants. These items were made of fabric, leather or metal and separate from the trousers or pants.

Modern jockstraps and athletic supporter are undergarments designed for supporting male genitalia during sports or other vigorous physical activity. A jockstrap consists of a waistband and a unitary genitalia support pouch in which the genitalia is held. The pouch may be fitted with fasteners or a pocket to secure a protective cup to protect male genitalia from physical impact and potential resulting injuries.

A disadvantage to these apparel and undergarments is that they lack a convenient fly to allow the wearer access to the undergarment interior.

Male undergarment underwear having a fly to allow a wearer access to the underwear interior is known.

Popular male underwear includes boxer-style underwear. Boxer-style underwear has the structure of a pair of shorts with a flat front fabric panel. A straight, vertically extending fly may be located in the front panel.

Other popular male underwear includes brief-style underwear. Brief-style underwear has a tighter crotch-fitting structure made up of one or more fabric panels. A Y-shaped fly formed by the uneven overlapping panels may be located at the brief front. Traditional Y-shaped fly openings can be difficult to use due to the uneven overlapping of fabric panels, resulting in forming an elongated fly aperture extending along one side or the other of the brief front and having a right or left "handedness" that complicates obtaining access to the underwear interior.

A disadvantage to male undergarment underwear is that it lacks structure to accommodate male genitalia, either undesirably compressing the genitalia against the body in the case of brief-style underwear or allowing the genitalia to hang unimpeded against the body, allowing undesired chafing in the case of boxer-style underwear.

Thus, there is a need for improved apparel and underwear having a pouch structure to accommodate and support a body part, particularly male genitalia, the pouch structure including an easily accessible fly opening and an easily manufactured structure.

SUMMARY OF THE INVENTION

The disclosure is of a garment having a pouch assembly with an easily accessible front fly opening.

The garment may be brief-style male underwear having a pouch assembly located at the front of the underwear brief to accommodate male genitalia, the pouch assembly having an easily accessible fly opening at the front of the pouch.

The pouch assembly may be manufactured from a flat pouch preform. The preform is assembled into a semi-spherical pouch having a fly opening at the front center of the pouch. The fly opening is formed from evenly overlapping fly edges to allow easy wearer access to the pouch interior.

The disclosed garment is inexpensive to produce is applicable in multiple garment applications aside from male underwear, including male swimwear having a like pouch assembly to accommodate male genitalia or other garments where the pouch assembly supports a portion of a wearer's body.

Other objects and features of the disclosure will become apparent as the description proceeds, especially when taken in conjunction with the accompanying drawing sheets illustrating the garment.

DETAILED DESCRIPTION OF THE INVENTION

Figure 1:
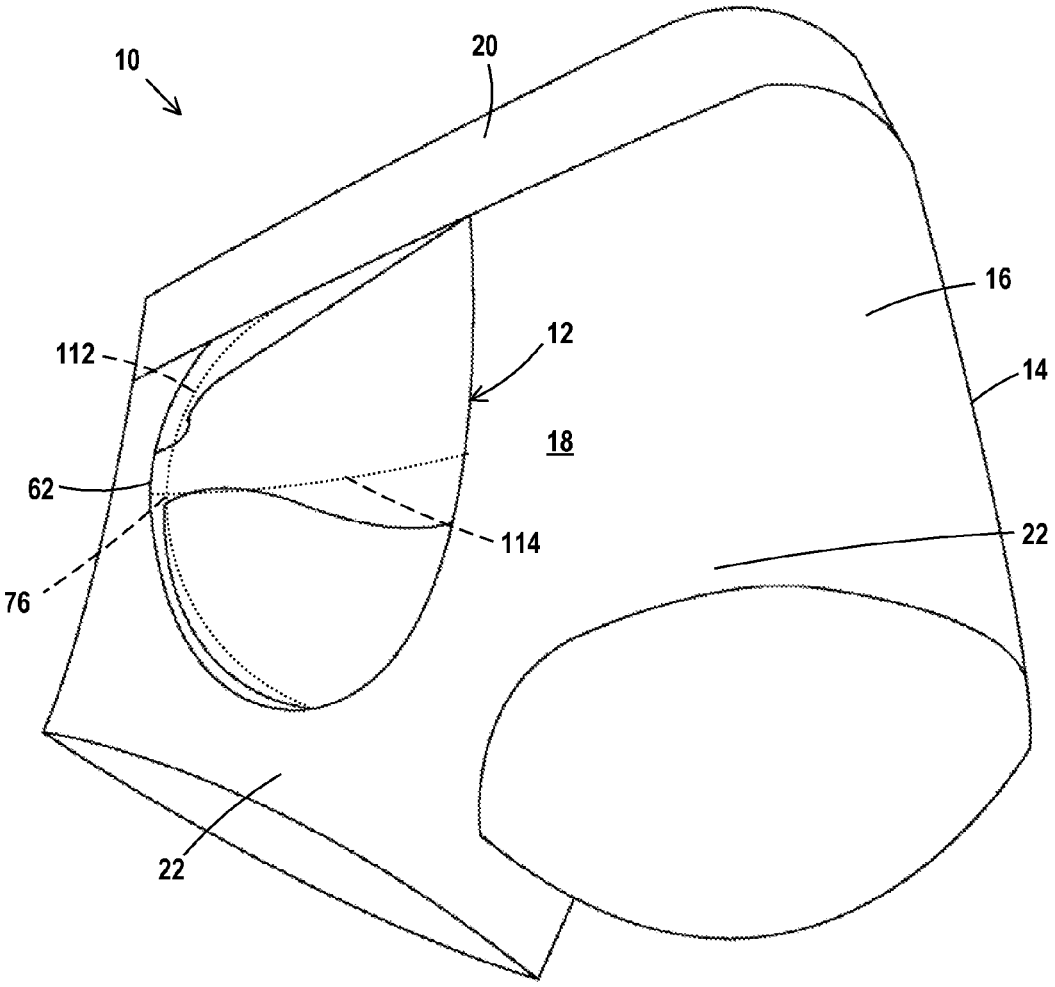
FIG. 1 is a perspective view of an apparel item having the pouch assembly.
Figure 2:
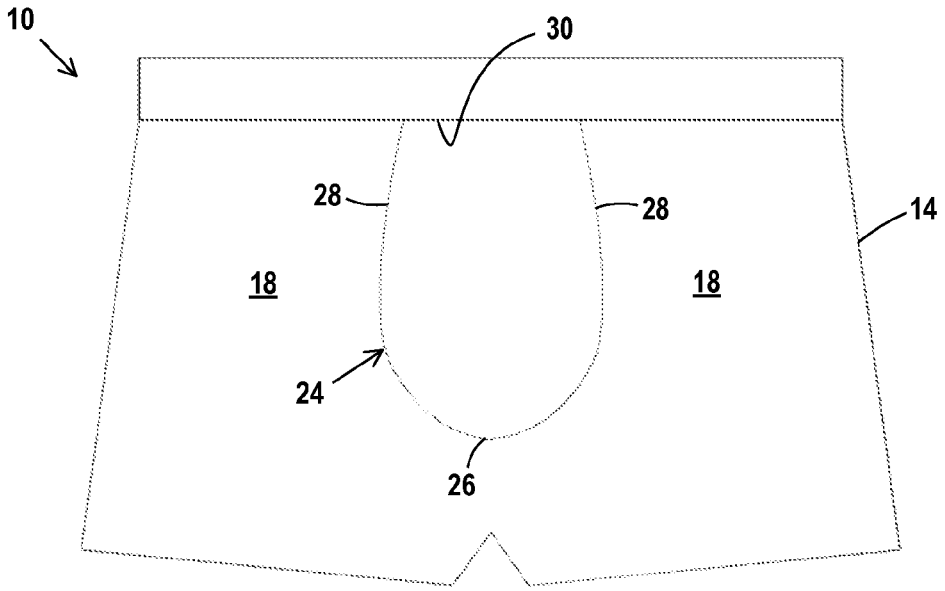
FIG. 2 is a front view of an apparel item before attachment of the assembly fabric preform.
Figure 3:
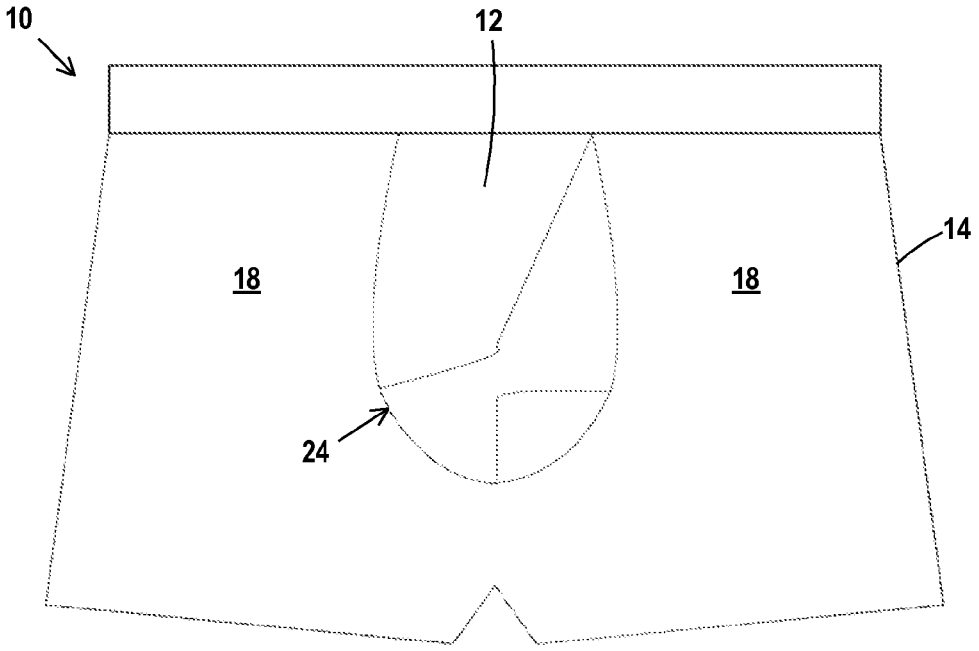
FIG. 3 is a front view of an apparel item having the pouch assembly.

FIG. 1 is a perspective view of a disclosed apparel item 10 having a pouch assembly 12.

As disclosed herein, apparel item 10 may be a pair of men's underwear, swimwear or like active wear item 14 worn on the lower body.

Apparel item 10 and pouch assembly 12 may be constructed of conventional known flexible clothing fabrics. Potential fabrics could be cotton, polyester, rayon, linen, fabric blends thereof and other fabrics known in the clothing art. In certain swimwear active wear applications, apparel item 10 and pouch assembly 12 may be constructed of known water-resistant spandex and nylon composite fabrics, wet suit or dry suit materials having neoprene and layers of vulcanized rubber and/or laminated layers of nylon, butyl or other rubber materials as appropriate.

Apparel item 10 may be an illustrated active wear item 14 having a generally tubular body 16 having a body front 18, an elastic waistband 20 at the top of body 16 for securing item 14 to a wearer's waist and a pair of legs 22 at the bottom of the body for accommodating a wearer's legs.

Apparel item 10 active wear item 14 has a body front 18 including a front aperture 24. Aperture 24 is generally U-shaped, having a parabolic bottom edge portion 26 and side edge portions 28 that extend upwardly to top edge portion 30.

Pouch assembly 12 is mounted to apparel item 10 at aperture 24 and extends outwardly from active wear body front 18.

Figure 4:
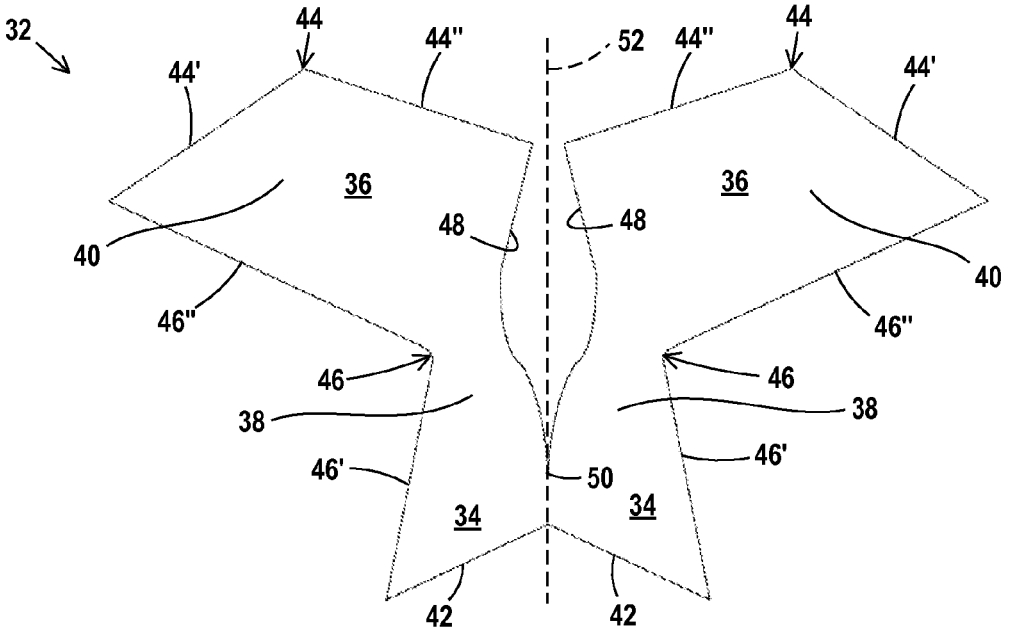
FIG. 4 is a front view of a pouch assembly preform.

Pouch assembly 12 may be formed from a generally flat pouch assembly preform 32. Pouch assembly preform 32 is generally V-shaped, having a preform base portion 34 at the bottom of the preform and two symmetrically-opposed arms 36 extending away from the base as illustrated in FIG. 4. Each arm 36 has a lower arm portion 38 proximate base portion 34 and an upper arm portion 40 distal and extending away from base portion 34.

Preform 32 may be cut from a flat piece of desired fabric material.

Pouch assembly preform 32 has a lower preform edge 42 extending along the bottom of preform base portion 34 and upper preform edges 44 extending along the top of each upper arm portion 40. Upper preform edge 44 is made up of first edge section 44' and second edge section 44". L-shaped outer preform edges 46 extend from lower preform edge 42 to an upper preform edge 44 along the outer sides of arms 36. Each outer preform edge 46 is made up of first edge section 46' and second edge section 46". Inner preform edges 48 extend from upper preform edge 44 along the inner edges of preform arm portions 38 and 40 to a base joint 50.

Pouch assembly preform 32 is symmetrical about either side of central preform vertical axis 52.

Figure 5:
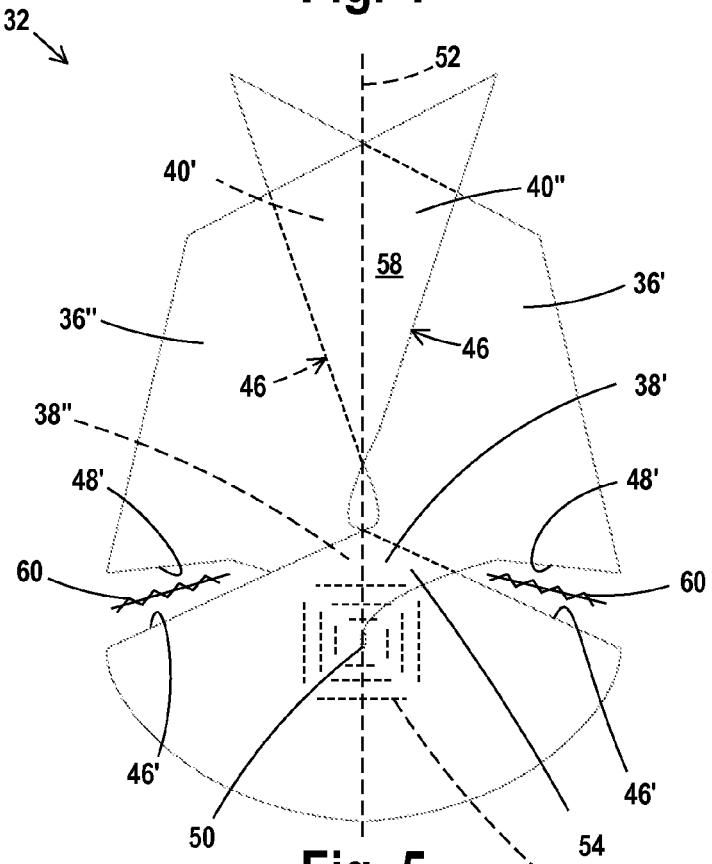
FIG. 5 is a front view of the pouch assembly preform in the process of being configured into a pouch assembly.

FIG. 5 illustrates pouch assembly preform 32 in the process of being configured into a pouch assembly 12.

First, a preform arm 36' is crossed over opposing preform arm 36" and central preform vertical axis 52 so that the arm 36' lower arm portion 38' extends over arm 36" lower arm portion 38". Simultaneously, preform arm 36" is crossed under opposing preform arm 36' and central preform vertical axis 52 so that the arm 36" lower arm portion 38" extends under arm 36' lower arm portion 38'.

The generally symmetrical structure of pouch assembly preform 32 about preform vertical axis 52, allows either preform arm 36 to be crossed over or under an opposing preform arm to the same effect.

Crossing lower arm portions 38' and 38" form preform overlapped lower arm portion 54 and brings inner preform edge first section 48' in proximity with outer preform edges first section 46' at each side of the preform 32 as shown in FIG. 5.

The action of crossing arms lower arm portion 38' and 38" over each other exerts forces onto preform base portion 34 and overlapped lower arm portion 54 to form outward bulge 56 in preform 32 proximate to base joint 50. See FIG. 5.

To continue configuring pouch assembly preform 32 into a pouch assembly 12, upper arm portion 40" is crossed over upper arm portion 40' so that L-shaped outer preform edges 46 cross and engage each other as shown in FIG. 5. Crossed upper arm portions 40' and 40" form preform fly overlap portion 58.

To complete the configuration process, preform 32 is pushed outward in the direction of outward bulge 56 to form pouch assembly 12 illustrated in FIGS. 6-9. To secure pouch assembly 12 in shape, proximate inner preform edge portions 48' and outer preform edge portions 46' are fastened together by stitching 60.

Pouch assembly 12 has a convex, semi-spherical body shell 62 defining a hollow pouch interior 64. Open pouch aperture 66 is located at the rear of the assembly. Pouch aperture 66 conforms to generally U-shaped edges of pouch assembly 12: parabolic bottom edge portion 68, side edge portions 70 and top edge portion 72. Edge portions 68, 70 and 72 make up pouch aperture perimeter edge 74. Perimeter edge 74 conforms generally in shape to active wear item 14 front aperture 24. Excess portions of preform 32 are folded or removed from the preform 32 to create pouch assembly 12 having a perimeter edge 74 of desired shape.

Pouch assembly semi-spherical body shell 62 extends from perimeter edge 74 to shell peak 76. Shell peak 76 coincides generally with the location of base joint 50.

Pouch assembly semi-spherical body shell 62 has a front fly 78. Front fly 78 is defined by generally evenly overlapping upper outer side preform edges 46".

Front fly 78 extends generally along central vertical axis 80 of pouch assembly 12 from base joint 50 to top edge portion 72.

Figure 6:
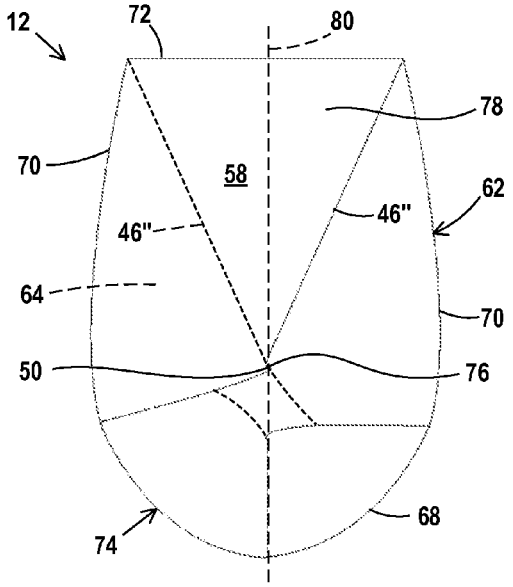
FIG. 6 is a front view of the pouch assembly alone.
Figure 7:
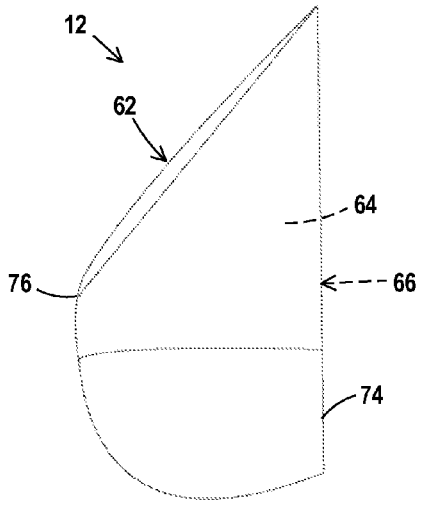
FIGS. 7 and 8 are side views of the pouch assembly alone.
Figure 8:
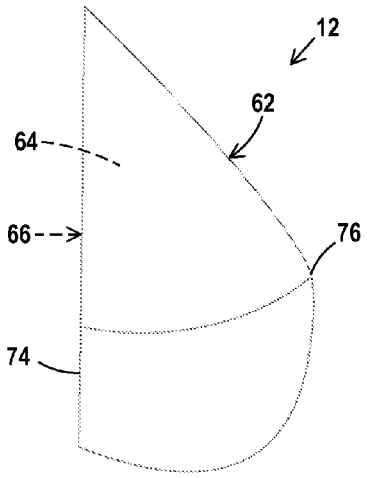
Figure 9:
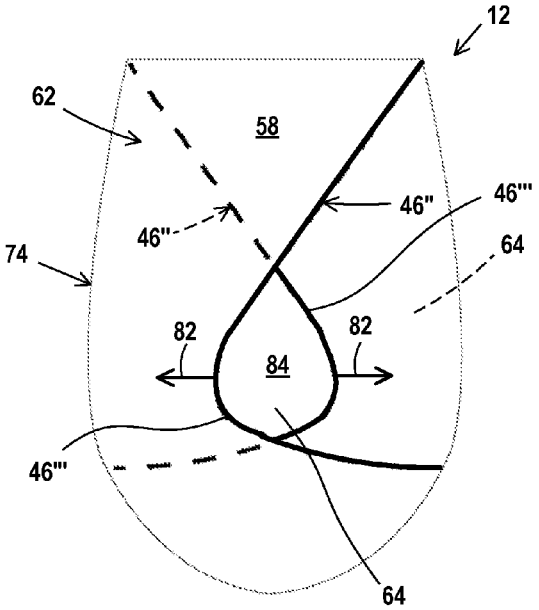
FIG. 9 is a front view of the pouch assembly illustrating an open front fly.

In a closed position, front fly 78 coextends with preform fly overlap portions 58. In a closed position, front fly 78 opposed preform edges 46" are located an equal distance from vertical axis 80 and has a generally triangular shape as shown in FIG. 6.

Figure 11:
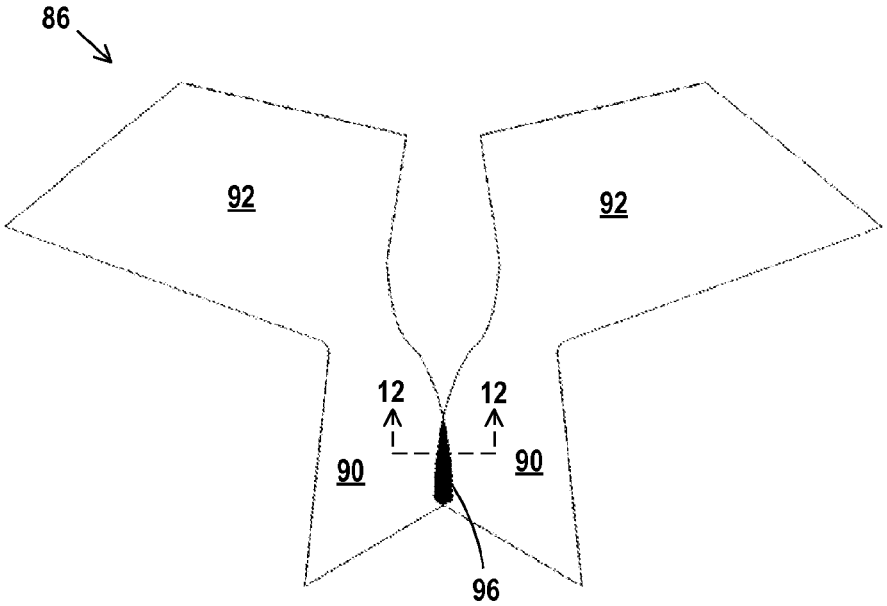
FIG. 11 is a view of an alternate embodiment pouch assembly preform.

Front fly 78 is opened by pulling each upper outer side preform edge 46" in the direction of arrows 82 as shown in FIG. 11 to form stressed and distorted side preform edges 46'" that define a fly aperture 84. As fly aperture 58 is opened, fly overlap area 58 decreases in size and a generally round fly aperture 84 is formed.

Fly aperture 84 allows a wearer access to pouch interior 64 from the exterior of pouch 12.

If desired, elastic banding or fasteners may be added to side preform edges 46" to assist in securing front fly 78 in a closed position. Hooks and loops type fasteners may be used or other mechanical fasteners such as buttons, snaps or the like may be used.

In applications in which the apparel item 10 and active wear item 14 is swimwear or like active wear item meant for wearing as an outerwear item, the size and shape of crossed upper arm portions 40' and 40" may be increased to form a preform fly overlap portion 58 of increased size. Having a larger fly overlap portion 58 provides additional security against the unintended opening of front fly 78 during swimming or like activities.

Figure 10:
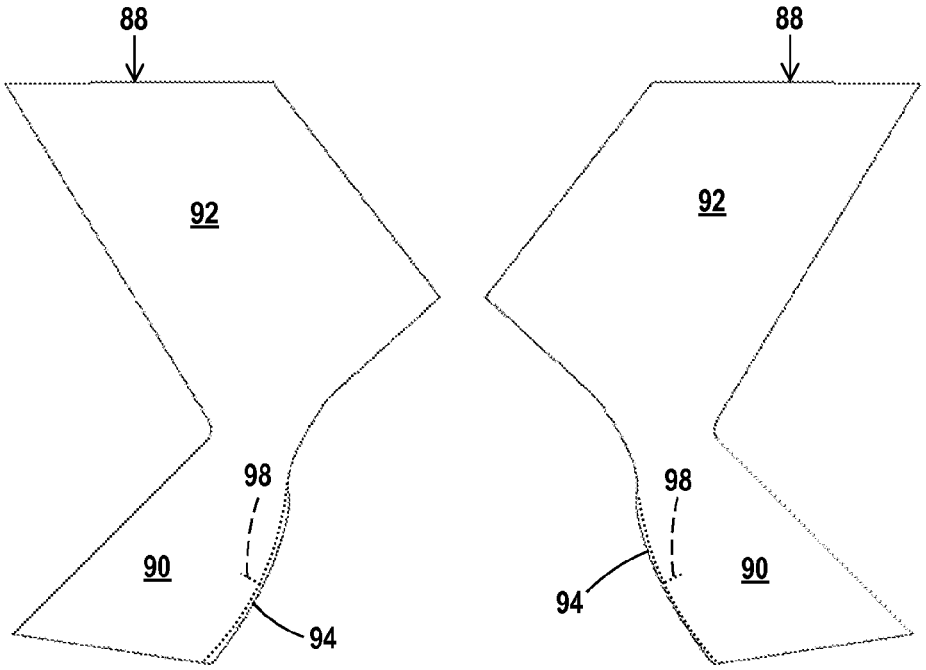
FIG. 10 is a view of alternate embodiment pouch assembly preform sub-units.

FIGS. 10 and 11 illustrate an alternate embodiment pouch assembly preform 86 for manufacture of a pouch assembly 12. Pouch assembly preform 86 is generally similar in form to preform 32 and is formed from two preform sub-units 88. Each subunit 88 is symmetrical to each other and is generally V-shaped. Each subunit 88 has a base section 90 and arm section 92. Each base section has an inner arcuate curved edge portion 94.

Figure 12:
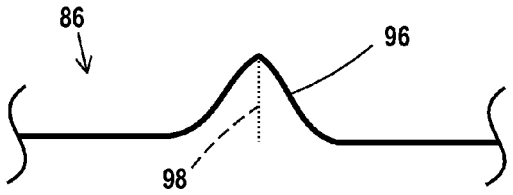
FIG. 12 is a sectional view taken along line 12-12 of FIG. 11.

In forming pouch assembly preform 86, two sub-units 88 are arranged so that arcuate curved edge portions 94 are aligned. Curved edge portions 94 are fastened together by stitching or like fabric fastened methods to form an outward extending bulge joint 96. Bulge joint 96 extends upwardly from the surface of flat pouch assembly preform 86 relative to the radius of curvature distance 98 of each arcuate curved edge portion 94. A larger radius of curvature distance 98 results in a larger upward extension of bulge joint 96. See FIG. 12.

Bulge joint 96 assists in formation of an outward preform bulge like outward bulge 56 in later pouch configuration steps.

Figure 13:
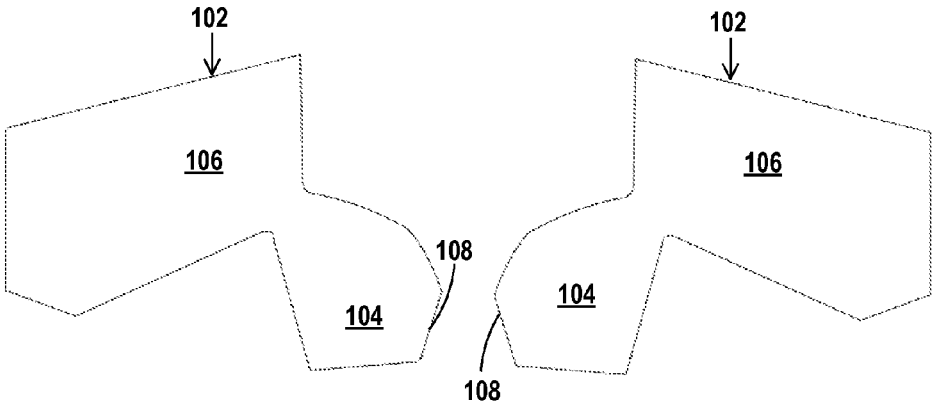
FIG. 13 is a view of another alternate embodiment pouch assembly preform sub-unit.
Figure 14:
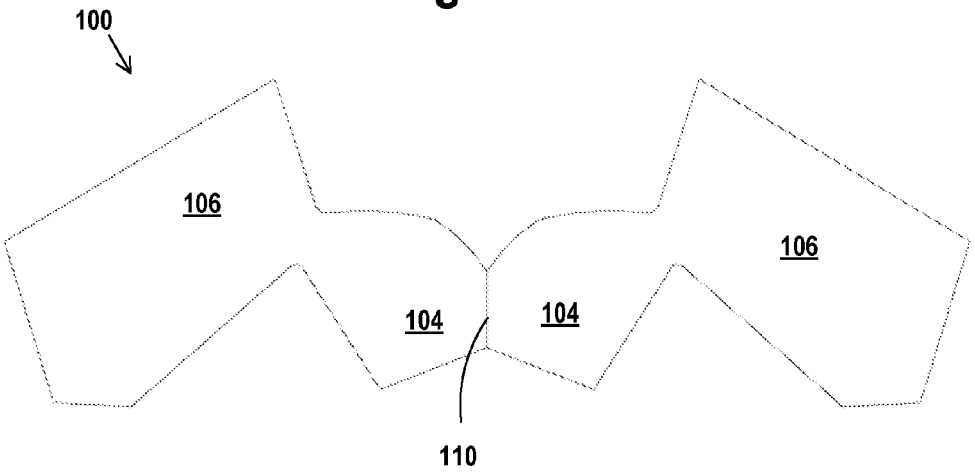
FIG. 14 is a view of another alternate embodiment pouch assembly preform.

FIGS. 13 and 14 illustrate another alternate embodiment pouch assembly preform 100 for manufacture of a pouch assembly 12. Pouch assembly preform 100 is generally similar in form to preform 86 and is formed from two preform sub-units 102 like sub-units 88. Each subunit 102 is symmetrical to each other and is generally V-shaped having base sections 104 and arm sections 106. Each base section has a linear inner edge portion 108.

In forming pouch assembly preform 100, two sub-units 102 are arranged so that inner edge portions 108 are aligned. Inner edge portions 108 are fastened together by stitching or like fabric fastener methods at joint 110.

As shown in FIG. 14, preform 100 is generally flat and W-shaped and symmetrical about joint 110.

Pouch assembly 12 is attached to apparel item 10 active wear item 14 by fastening pouch aperture perimeter edge 74 to front aperture 24. Pouch interior 64 is continuous with the interior of apparel item 10.

Pouch assembly 12 allows for support of a wearers body parts within pouch interior 64 with easy pouch access gained through fly aperture 78. Pouch assembly 12 pouch interior 64 contains a comfortable semi-spherical interior space for accommodating a wearer's body parts. Pouch interior 64 is defined by semi-spherical body shell 62 defined by outward shell surface semi-circumferential vertically extending arc 112 and outward shell surface semi-circumferential horizontally extending arc 114. Arcs 112 and 114 intersect proximate shell peak 76. Fly overlap portion 58 extends generally along arc 112.

While the present disclosure shows formation of pouch assembly 12 from an assembly preforms 86 and 100 made up of two sub-units fastened together, use of assembly preforms made up of more than two sub-units fastened together is also contemplated.

While the present disclosure shows formation of pouch assembly 12 from generally flat assembly preforms 32, 86 and 100, formation of pouch assembly 12 from an assembly preform having a curved surface to assist in formation of the disclosed outward bulge 56 and semi-spherical body shell 62 is also contemplated.

While the present disclosure focuses on the pouch assembly supporting male genitalia in male active wear applications, other implementations of the pouch assembly are contemplated, including use of the pouch assembly in a brassier apparel item for supporting breasts wherein the fly aperture access for breast feeding applications.

What is claimed is:

1. A flexible garment pouch formed from a preform, the preform having a preform base portion and two opposing preform arms extending away from the preform base portion, each preform arm extending symmetrically away from the other preform arm about a central preform vertical axis, each preform arm having a lower arm portion located proximate the preform base portion and an upper arm portion distal from the base portion and extending away from the central preform vertical axis, the preform having outer side preform edges extending from the base along the outer sides of the preform to an upper preform edge on each arm and inner preform edges extending from each upper preform edge to a base joint proximate the base portion, a preform arm crossed over an opposing preform and the central preform vertical axis so that a preform arm's lower arm portion extends over or under an opposing preform arm's lower arm portion to form a preform overlapped lower arm portion and so that a portion of each inner preform edge is proximate with a portion of each inner outer side preform edge and so that each upper arm portion is generally evenly overlapped with an opposed upper arm portion to form a fly overlap portion, said preform forming a convex semi-spherical body shell extending from a pouch aperture to shell peak, the body shell having a semi-circumferential vertically extending arc and an intersecting semi-circumferential horizontally extending arc, said arcs intersecting proximate the shell peak, the body shell defining the pouch and having a hollow pouch interior, a fly overlap portion extending along the semi-circumferential vertically extending arc defining a closed pouch fly, wherein the pouch fly is opened by pulling opposed upper arm portions from the fly overlap portion away from each other to form a fly aperture to allow access to the hollow pouch interior.

2. The flexible garment pouch of claim 1 wherein the preform is generally V-shaped.

3. The flexible garment pouch of claim 2 wherein the pouch aperture is fastened to an apparel item front aperture.

4. The flexible garment pouch of claim 1 wherein the preform overlapped lower arm portion comprises a preform outward bulge or bulge joint proximate the preform base portion, wherein the bulge extends in the same direction as the pouch.

5. The flexible garment pouch of claim 2 wherein the outer preform edges are generally L-shaped.

6. The flexible garment pouch of claim 5 wherein the fly overlap portion comprises elastic wherein the elastic assists in securing the pouch fly closed.

7. The flexible garment pouch of claim 1 wherein the garment pouch and apparel item is constructed of a water-resistant fabric.

8. The flexible garment pouch of claim 7 wherein the fly overlap comprises one or more fasteners, wherein the fasteners assists in securing the pouch fly closed.

9. The flexible garment pouch of claim 1 wherein the portion of each inner preform edge proximate with the portion of each inner outer side preform edge is fastened to each other.

10. The flexible garment pouch of claim 1 wherein the preform is made up of two or more preform sub-units.

11. An apparel item having a front aperture and a flexible garment pouch having a convex semi-spherical body shell having a hollow pouch interior and extending from a pouch aperture to shell peak, the pouch aperture fastened to the apparel item front aperture, the body shell having a fly overlap portion extending along a semi-circumferential vertically extending arc along the shell, the body shell comprising a preform, the preform having a preform base portion and two opposing preform arms extending away from the preform base portion, each preform arm extending symmetrically away from the other preform arm about a central preform vertical axis, each preform arm having a lower arm portion located proximate the preform base portion and an upper arm portion distal from the base portion and extending away from the central preform vertical axis, the preform having outer side preform edges extending from the base along the outer sides of the preform to an upper preform edge on each arm and inner preform edges extending from each upper preform edge to a base joint proximate the base portion, a preform arm crossed over an opposing preform and the central preform vertical axis so that a preform arm's lower arm portion extends over or under an opposing preform arm's lower arm portion to form a preform overlapped lower arm portion and so that a portion of each inner preform edge is proximate with a portion of each inner outer side preform edge and so that each upper arm portion is generally evenly overlapped with an opposed upper arm portion to form the fly overlap portion, said preform configured into the body shell.

12. The apparel item of claim 11 wherein the preform is generally V-shaped.

13. The apparel item of claim 12 wherein the fly overlap portion is opened by pulling opposed upper arm portions from the fly overlap portion away from each other to form a fly aperture to allow access to the hollow pouch interior and apparel item front aperture.

14. The apparel item claim 12 wherein the preform is made up of two or more preform sub-units.

15. The flexible garment pouch of claim 12 wherein the outer preform edges are generally L-shaped.

16. The flexible garment pouch of claim 15 wherein the fly overlap portion comprises elastic or fasteners wherein the elastic or fasteners assists in securing the fly overlap portion closed.

17. A flexible garment pouch assembled by the steps of:

A. Providing a preform having a preform base portion and two opposing preform arms extending away from the preform base portion, each preform arm extending symmetrically away from the other preform arm about a central preform vertical axis, each preform arm having a lower arm portion located proximate the preform base portion and an upper arm portion distal from the base portion and extending away from the central preform vertical axis, the preform having outer side preform edges extending from the base along the outer sides of the preform to an upper preform edge on each arm and inner preform edges extending from each upper preform edge to a base joint proximate the base portion;

B. Crossing a preform arm crossed over an opposing preform and the central preform vertical axis so that the preform arm's lower arm portion extends over or under an opposing preform arm's lower arm portion to form a preform overlapped lower arm portion;

C. Locating a portion of each inner preform edge proximate with a portion of each inner outer side preform edge so that each upper arm portion is generally evenly overlapped with the opposed upper arm portion to form a fly overlap portion; and D. Forming a convex semi-spherical body shell from said preform, the body shell having a pouch aperture and extending from the pouch aperture to a shell peak and the body shell having a semi-circumferential vertically extending arc and a semi-circumferential horizontally extending arc, said arcs intersecting proximate the shell peak, the body shell defining the pouch and having a hollow pouch interior, a fly overlap portion extending along the semi-circumferential vertically extending arc defining a closed pouch fly wherein the pouch fly is opened by pulling opposed upper arm portions from the fly overlap portion away from each other to form a fly aperture to allow access to the hollow pouch interior.

18. The flexible garment pouch of claim 17 wherein preform is generally V-shaped.

19. The flexible garment pouch of claim 18 wherein the preform is made up of two or more preform sub-units.

20. The flexible garment pouch of claim 19 wherein the outer preform edges are generally L-shaped and comprise elastic.

* * * * *